United States Patent [19]

Henry, Jr.

[11] Patent Number: 5,027,755

[45] Date of Patent: Jul. 2, 1991

[54] WOBBLE PLATE INTERNAL COMBUSTION ENGINE

[76] Inventor: Weston W. Henry, Jr., 2560 Mapleswamp Rd., N. Dighton, Mass. 02764

[21] Appl. No.: 527,855

[22] Filed: May 24, 1990

[51] Int. Cl.[5] ..... F02B 75/26

[52] U.S. Cl. ..... 123/58 B

[58] Field of Search ..... 123/58 B, 58 BA, 58 BB, 123/58 BC

[56] References Cited

U.S. PATENT DOCUMENTS

| | | | |
|---|---|---|---|
| 1,042,018 | 10/1912 | Macomber | 123/58 BA |
| 3,319,874 | 5/1967 | Welsh et al. | 123/58 BA |
| 3,939,809 | 2/1976 | Rohs | 123/58 B |
| 4,003,352 | 1/1977 | Rogojew | 123/58 B |
| 4,174,684 | 11/1979 | Roseby et al. | 123/58 BA |
| 4,195,612 | 4/1980 | Klaue | 123/58 B |
| 4,203,396 | 5/1980 | Berger | 123/58 B |
| 4,781,152 | 11/1988 | Pellerin | 123/58 B |

FOREIGN PATENT DOCUMENTS

| | | | |
|---|---|---|---|
| 0060822 | 9/1982 | European Pat. Off. | 123/58 B |
| 2931377 | 2/1981 | Fed. Rep. of Germany | 123/58 BA |
| 3043352 | 1/1983 | Fed. Rep. of Germany | 123/58 B |
| 3800005 | 7/1988 | Fed. Rep. of Germany | 123/58 B |
| 2461813 | 3/1981 | France | 123/58 B |

*Primary Examiner*—David A. Okonsky

*Attorney, Agent, or Firm*—Leon Gilden

[57] ABSTRACT

A multi-cylinder wobble plate engine includes a two-part wobble plate, wherein an inner part is fixedly mounted to an elongate longitudinally aligned main shaft, with an external portion of the wobble plate fixedly mounted relative to a surrounding housing utilizing a stabilizer rod, wherein a plurality of piston rods utilizing swivel bearings are mounted to the periphery of the external wobble plate. Stroke of the engine is determined by angle inclination of the wobble plate relative to the main shaft. An overhead valve assembly is operative through a gear drive in association with a gear mounted on the main shaft to direct actuation of intake in exhaust valves utilized in a conventional four-cycle internal combustion engine. A cam plate utilizing a plurality of pairs of cam plate projections actuates the valves directly and is operative at a one-quarter speed of the main shaft in a reverse direction to that of the main shaft.

1 Claim, 8 Drawing Sheets

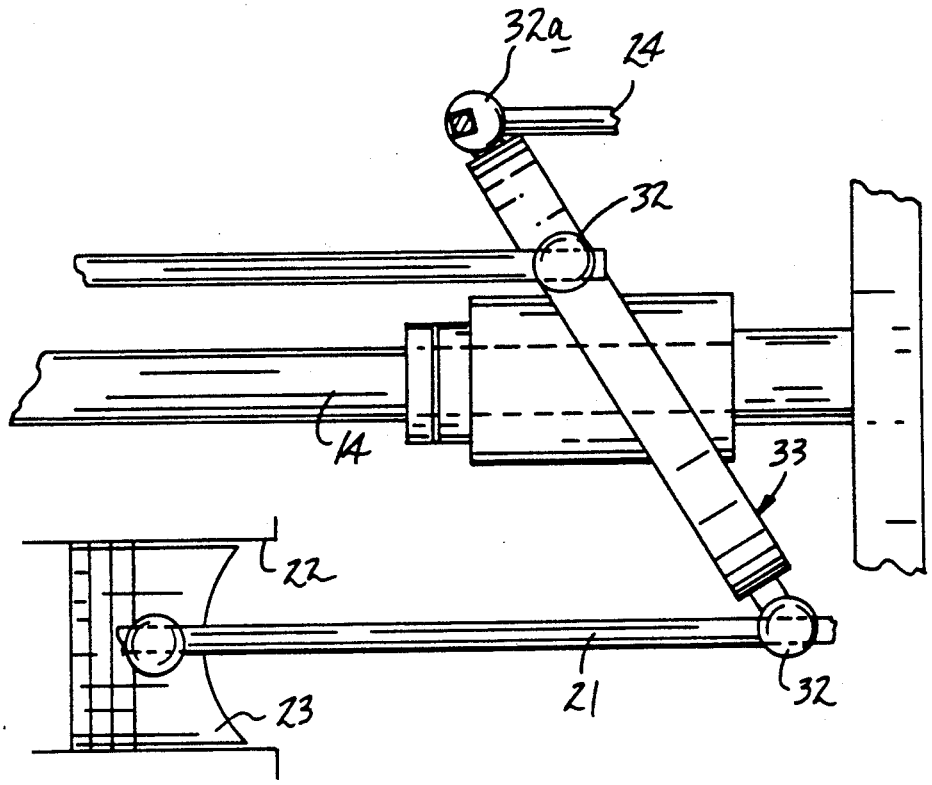
Fig 8
Fig 9
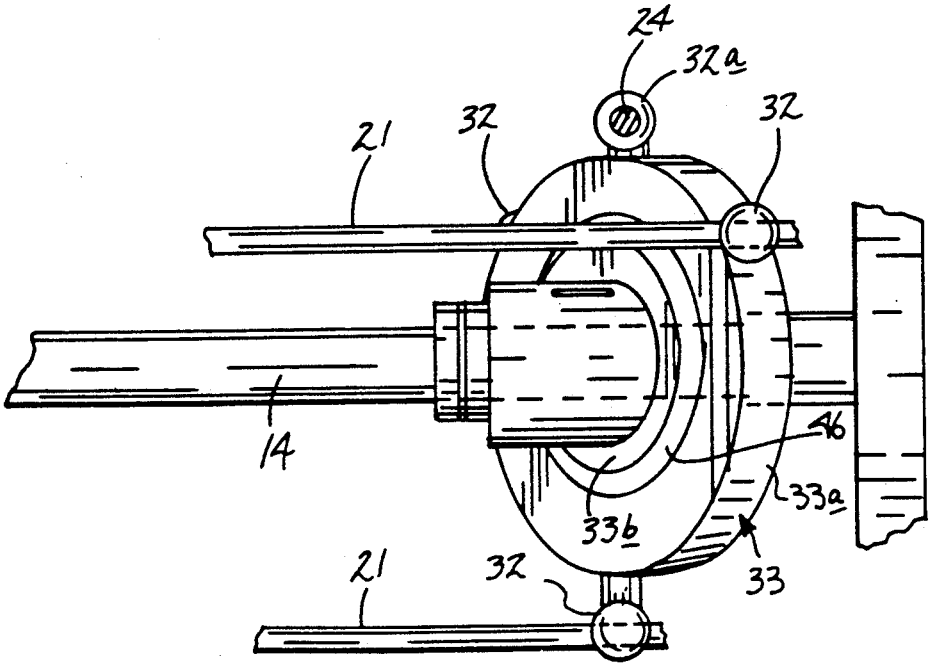

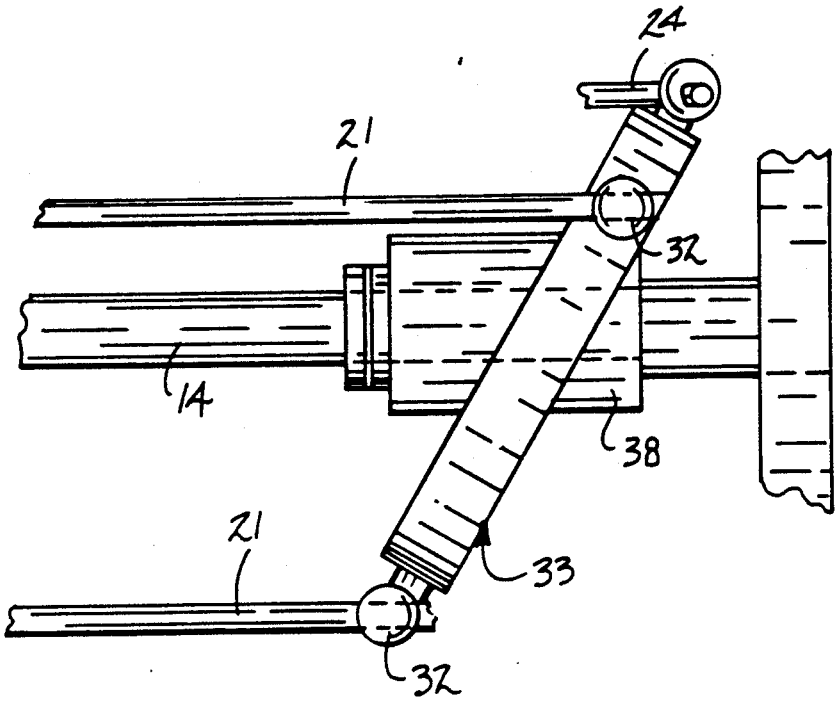
FIG. 11
FIG. 12
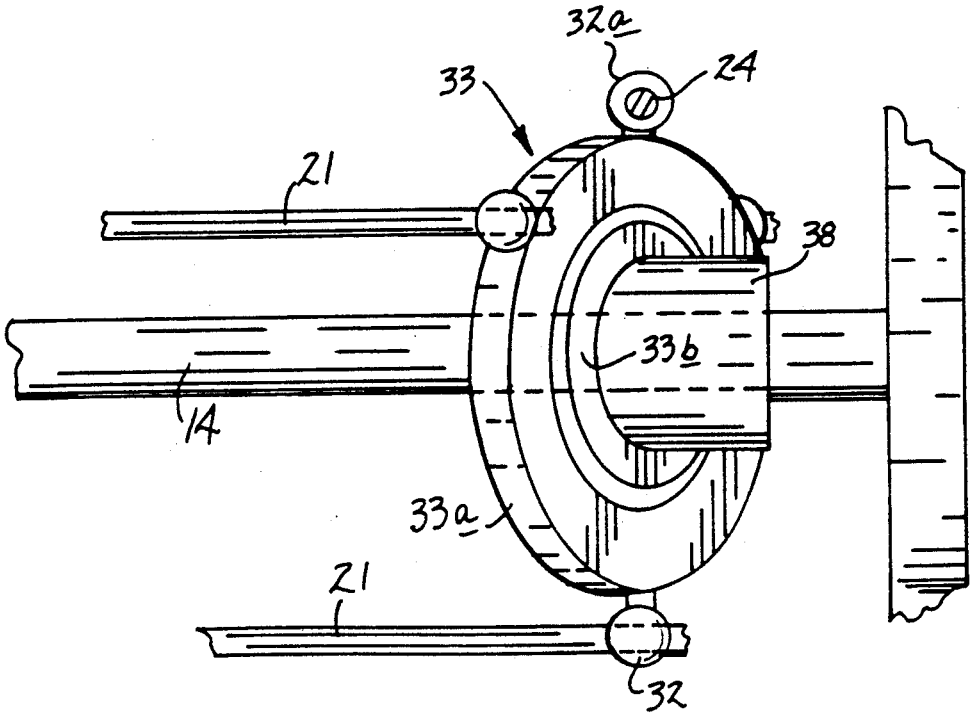

WOBBLE PLATE INTERNAL COMBUSTION ENGINE

BACKGROUND OF THE INVENTION

1. Field of the Invention

The field of invention relates to internal combustion engines, and more particularly pertains to a new and improved wobble plate internal combustion engine wherein the same compactly and efficiently effects rotation of an associated main shaft during reciprocation of pistons within the engine housing.

2. Description of the Prior Art

Wobble plate engines have been utilized in the prior art utilizing a plurality of pistons and cylinders arranged around a central crank shaft axis coupled to an associated wobbler plate, wherein the wobbler plate is mounted obliquely upon an associated main shaft. The instant invention attempts to set forth a compact wobble plate engine utilizing a cam plate to direct overhead actuation of valves in association with a piston cylinder arrangement within the engine. Examples of wobbler plate configurations set forth by the prior art may be found in U.S. Pat. No. 4,433,596 to Scalzo setting forth a variable displacement wobble plate mechanism.

U.S. Pat. No. 2,940,325 to Nakesche wherein a wobbler plate-type engine utilizes a pivot connection mounted to an underlying shaft to effect rotation of an associated fly wheel.

U.S. Pat. No. 4,203,396 to Berger sets forth a barrel engine with a rocking ball drive pivotally interconnecting opposed reciprocating pistons.

U.S. Pat. No. 4,489,682 to Kenny wherein a wobbler or swash plate-type motor is set forth utilizing each piston fixedly mounted directly to an associated wobbler plate.

As such, it may be appreciated that there continues to be a need for a new and improved wobble plate internal combustion engine wherein the same addresses both the problems of compactness of construction, as well as efficiency in operation and in this respect, the present invention substantially fulfills this need.

SUMMARY OF THE INVENTION

In view of the foregoing disadvantages inherent in the known types of wobbler plate engines now present in the prior art, the present invention provides a wobble plate internal combustion engine wherein the same utilizes a compact overhead cam organization actuated directly by gear association of the associated main shaft of the engine. As such, the general purpose of the present invention, which will be described subsequently in greater detail, is to provide a new and improved wobble plate internal combustion engine which has all the advantages of the prior art wobbler plate engines and none of the disadvantages.

To attain this, the present invention provides a multi-cylinder wobble plate engine including a two-part wobble plate, wherein an inner part is fixedly mounted to an elongate longitudinally aligned main shaft, with an external portion of the wobble plate fixedly mounted relative to a surrounding housing utilizing a stabilizer rod, wherein a plurality of piston rods utilizing swivel bearings are mounted to the periphery of the external wobble plate. Stroke of the engine is determined by angle inclination of the wobble plate relative to the main shaft. An overhead valve assembly is operative through a gear drive in association with a gear mounted on the main shaft to direct actuation of intake in exhaust valves utilized in a conventional four-cycle internal combustion engine. A cam plate utilizing a plurality of pairs of cam plate projections actuates the valves directly and is operative at a one-quarter speed of the main shaft in a reverse direction to that of the main shaft.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended thereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the prupose of the foregoing abstract is to enable the U.S. Pat. and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved wobble plate internal combustion engine which has all the advantages of the prior art wobbler plate engines and none of the disadvantages.

It is another object of the present invention to provide a new and improved wobble plate internal combustion engines which may be easily and efficiently manufactured and marketed.

It is a further object of the present invention to provide a new and improved wobble plate internal combustion engine which is of a durable and reliable construction.

An even further object of the present invention is to provide a new and improved wobble plate internal combustion engine which is susceptible of a low cost of manufacture with regard to both materials and labor, and which accordingly is then susceptible of low prices of sale to the consuming public, thereby making such wobble plate internal combustion engines economically available to the buying public.

Still yet another object of the present invention is to provide a new and improved wobble plate internal combustion engine which provides in the apparatuses and methods of the prior art some of the advantages thereof, while simultaneously overcoming some of the disadvantages normally associated therewith.

Still another object of the present invention is to provide a new and improved wobble plate internal combustion engine wherein the same effects overhead cam actuation of the valve mechanism of the engine actuating a trio of cylinders utilizing a plurality of pairs of cam lobes mounted upon an associated cam plate.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 8 is an orthographic side view, taken in elevation, of the wobbler plate and piston relationship.

FIG. 9 is a further orthographic side view of the wobble plate and piston rod association.

FIG. 10 is an orthographic side view, taken in elevation, of the wobbler plate and piston rod relationship.

FIG. 11 is further orthographic side view of the wobbler plate and piston rod relationship.

DESCRIPTION OF THE PREFERRED EMBODIMENT

Figure 1:
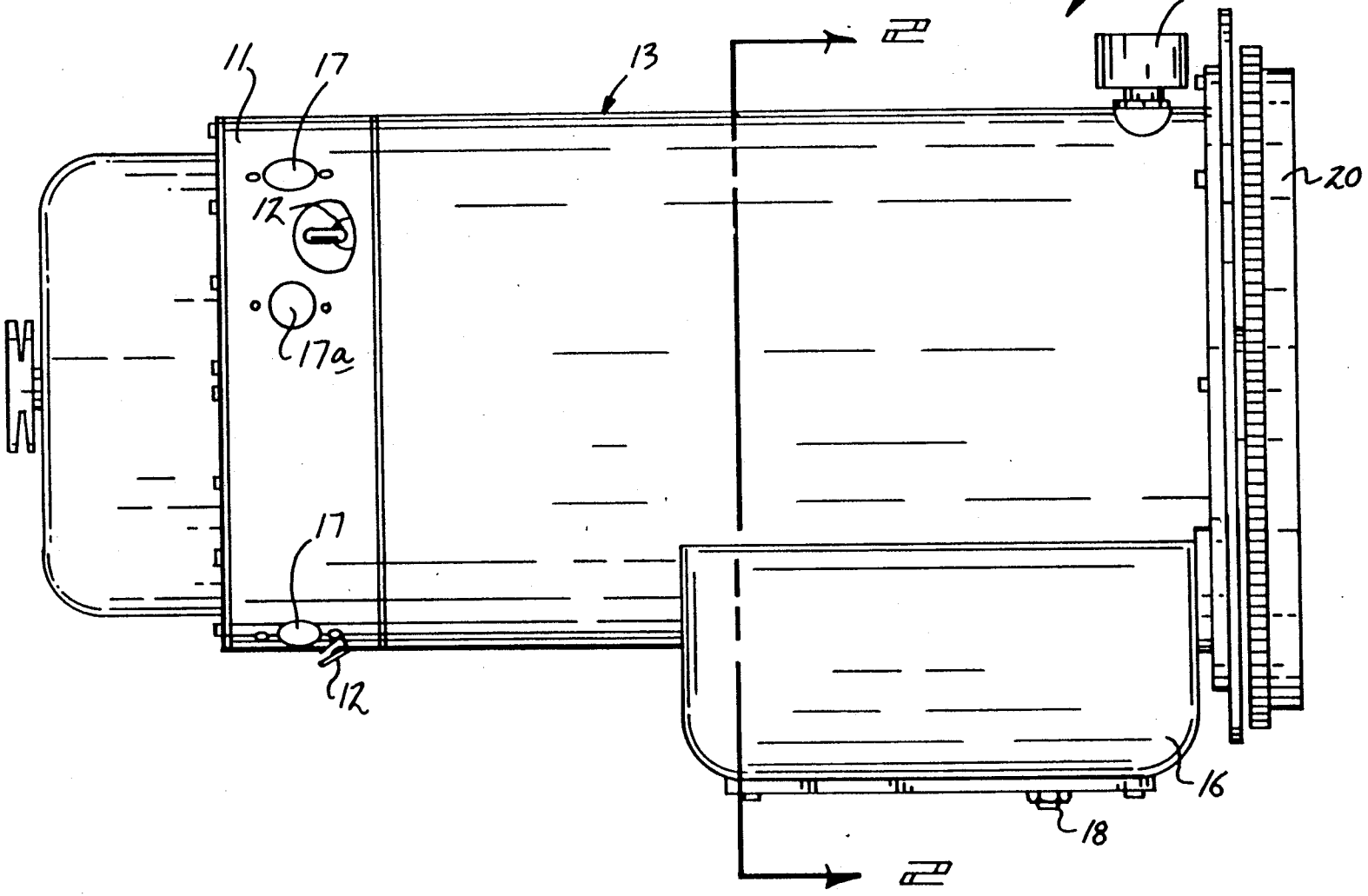
FIG. 1 is an orthographic side view, taken in elevation, of the instant invention.
Figure 2:
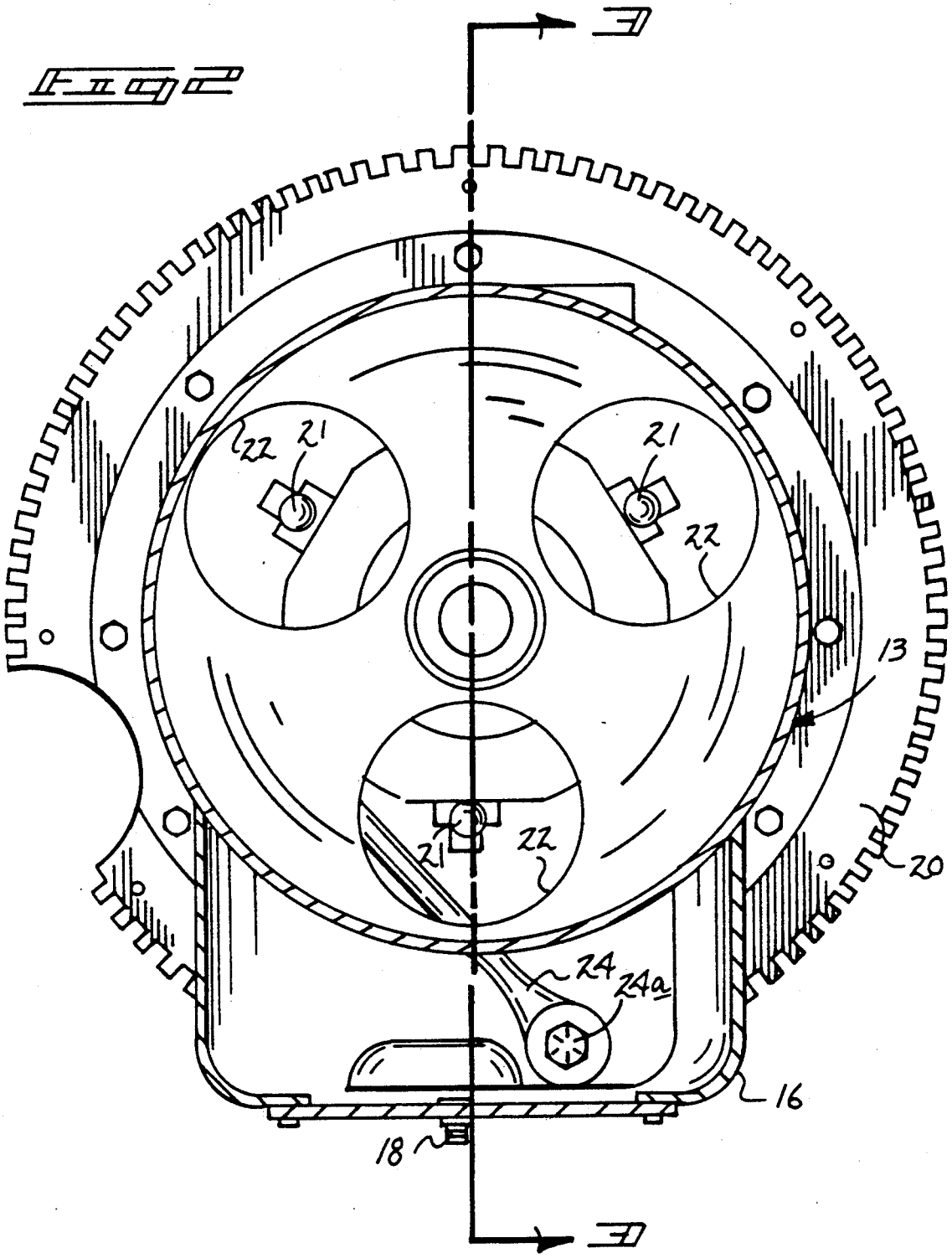
FIG. 2 is an orthographic cross-sectional view of the instant invention illustrating the association of the cylinders in relation within the engine housing.

With reference now to the drawings, and in particular to FIGS. 1 to 11 thereof, a new and improved wobble plate internal combustion engine embodying the principles and concepts of the present invention and generally designated by the reference numeral 10 will be described.

Figure 3:
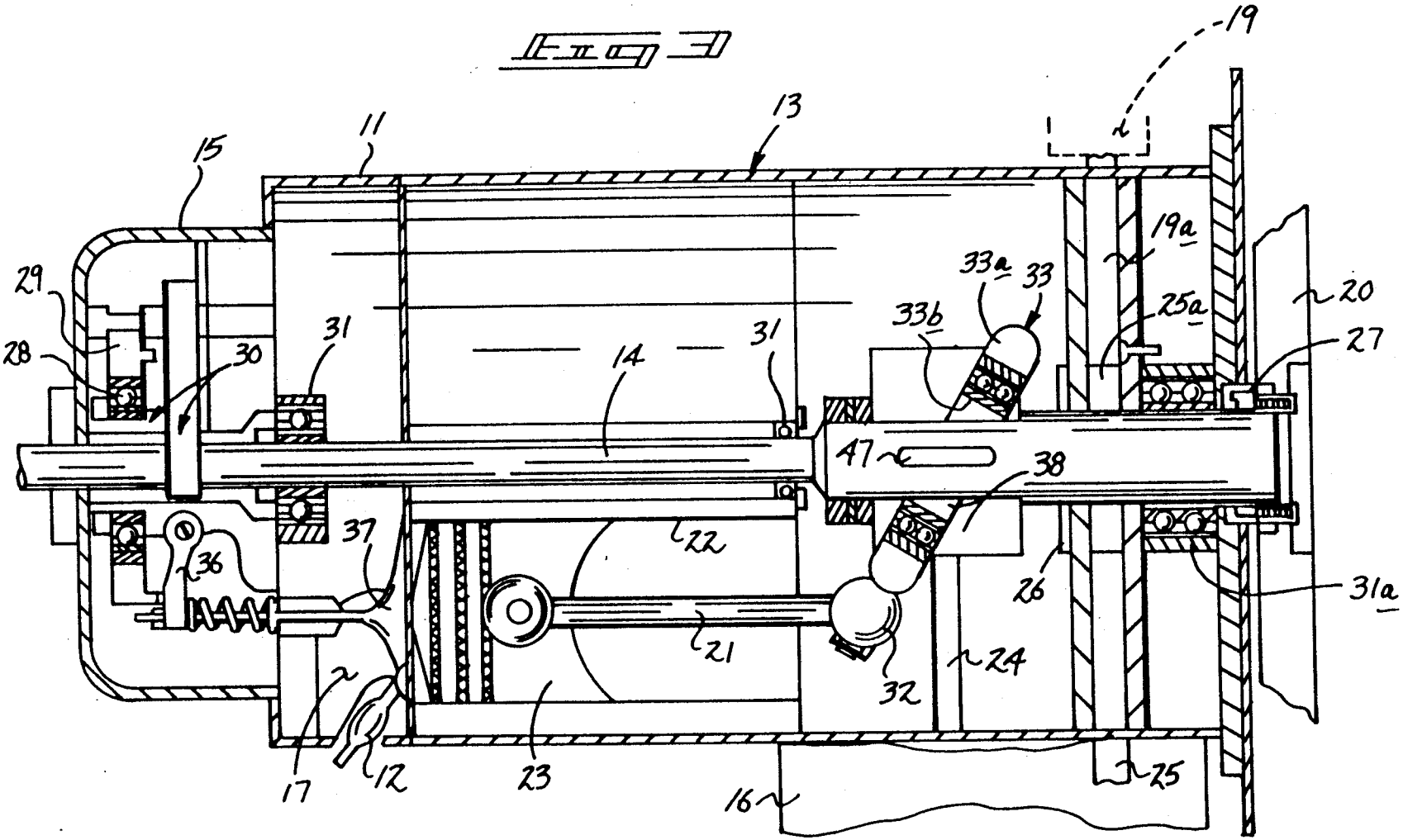
FIG. 3 is an orthographic cross-sectional view, taken along the lines 3—3 of FIG. 2, in the direction indicated by the arrows.
Figure 4:
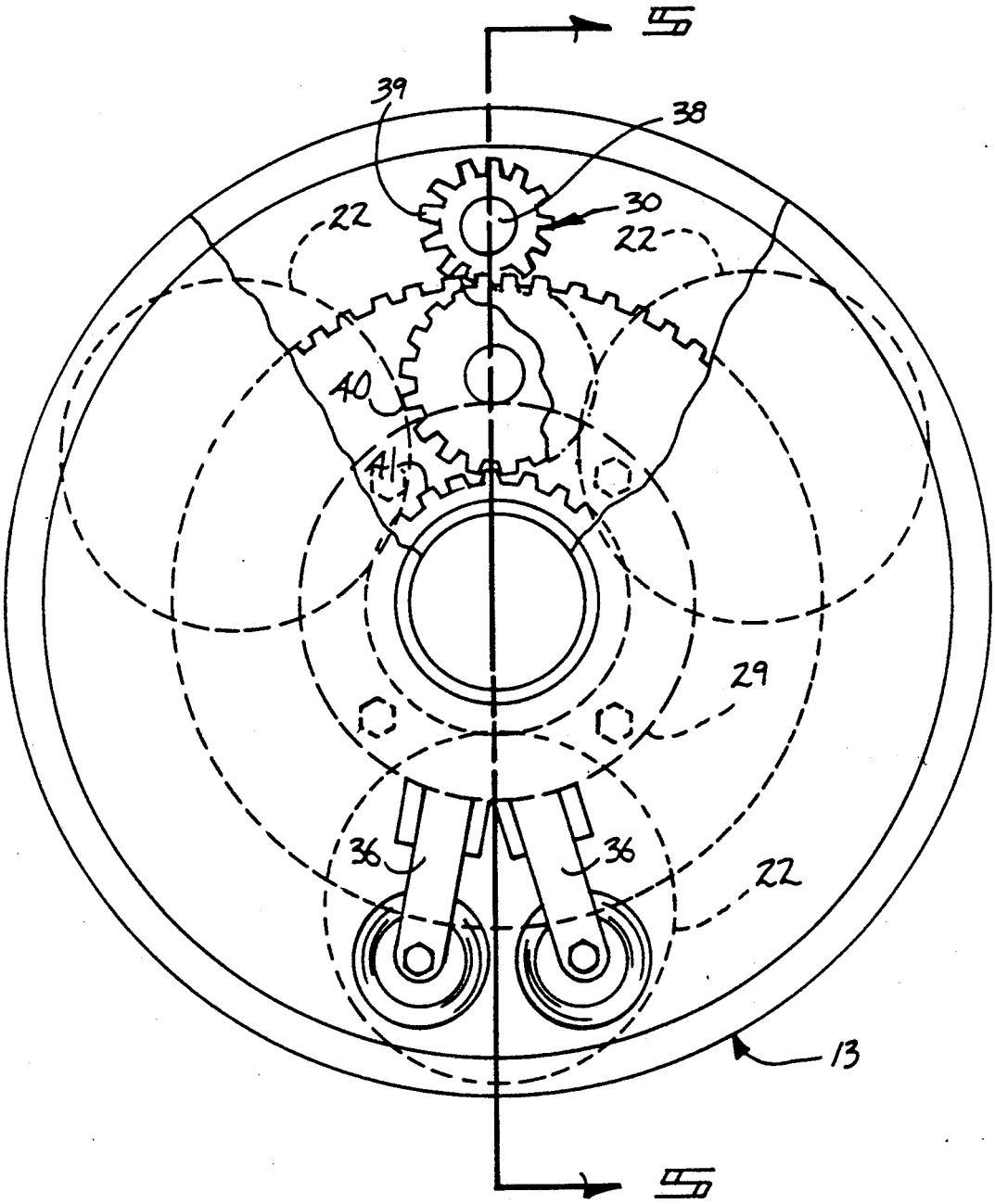
FIG. 4 is an orthographic top view, partially in section, of the valve mechanism of the instant invention.
Figure 5:
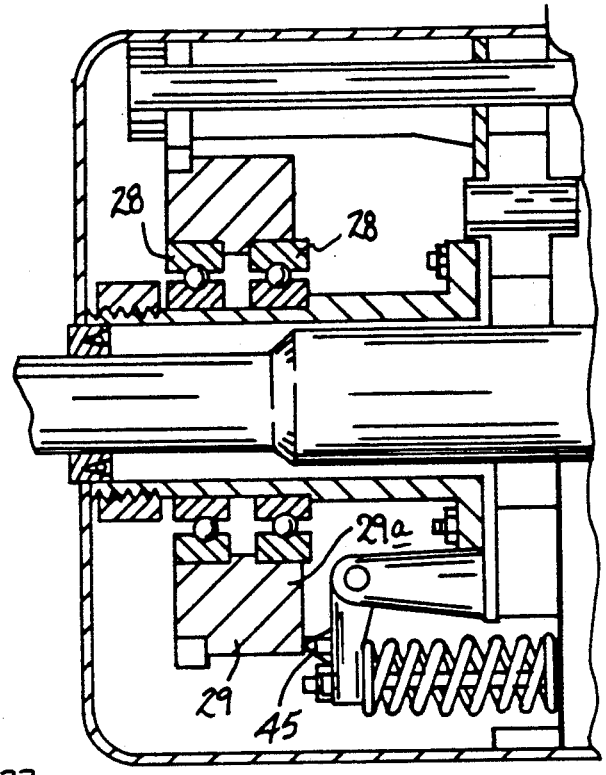
FIG. 5 is an orthographic view, taken along the lines 5—5 of FIG. 4, in the direction indicated by the arrows.
Figure 6:
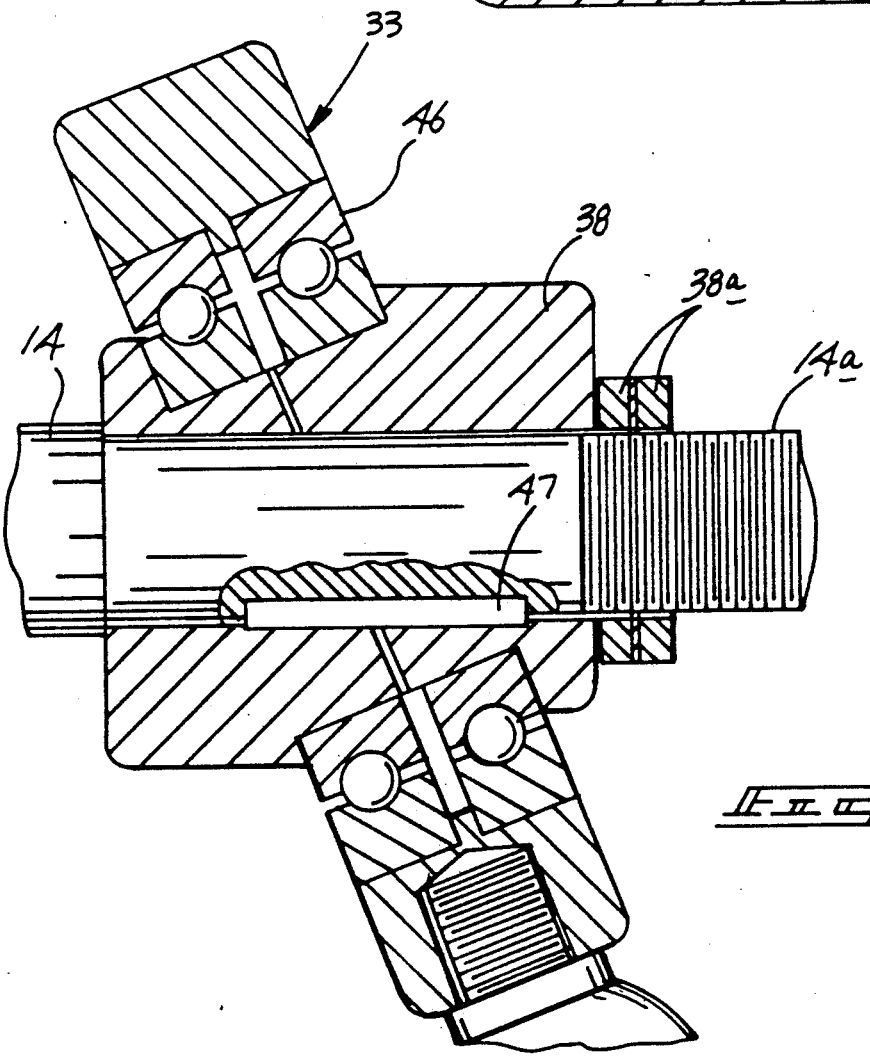
FIG. 6 is an orthographic cross-sectional view of the wobbler plate assembly mounted to the main shaft.
Figure 7:
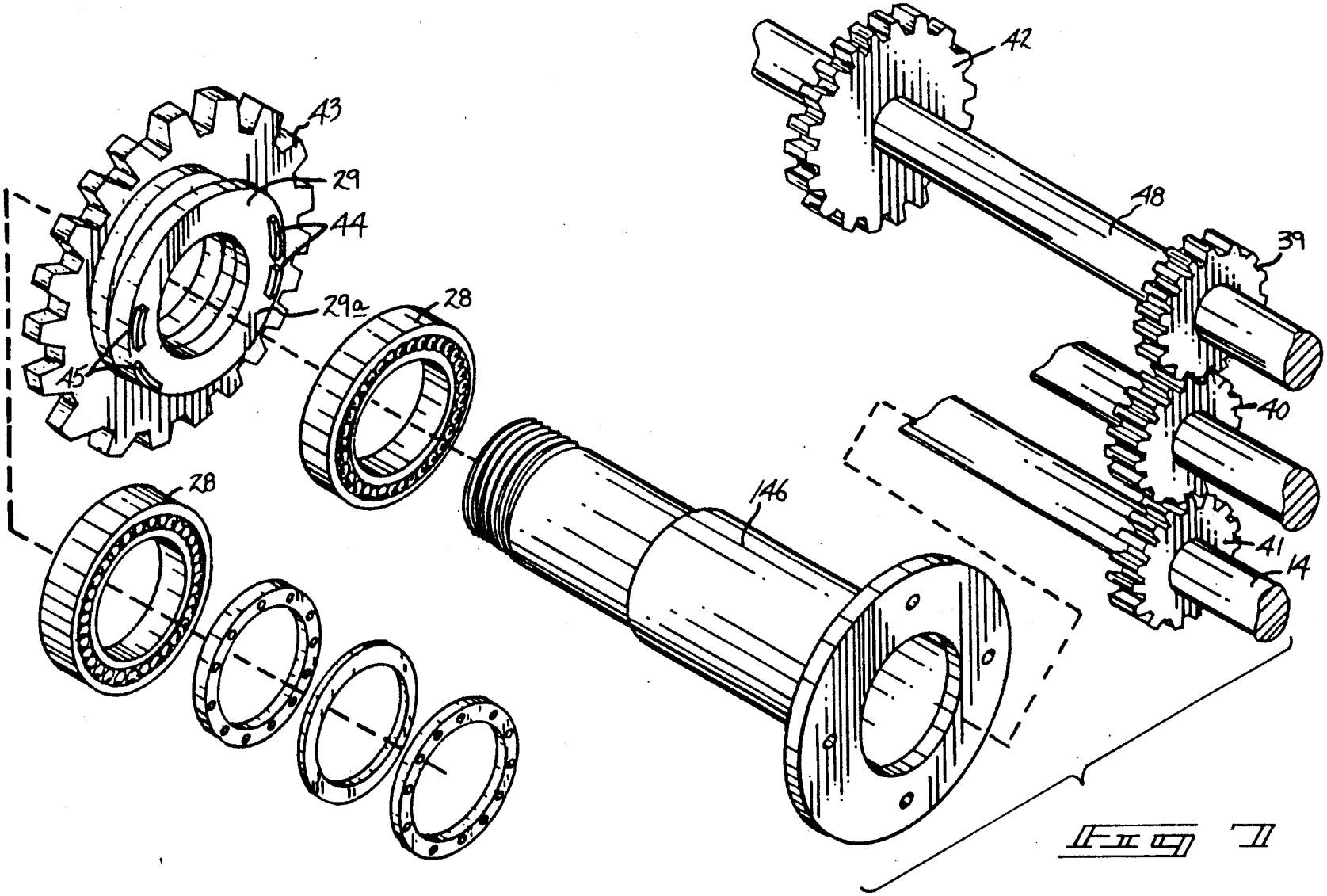
FIG. 7 is an isometric illustration, somewhat exploded, of the cam plate and drive mechanism.

More specifically, the wobble plate internal combustion engine 10 of the instant invention essentially comprises an elongate longitudinally aligned engine block housing 13, including a cylinder head mounted to a forward terminal end thereof, wherein the cylinder head 11 includes a spark plug 12 associated with each cylinder. It is contemplated that three cylinders be faced in a coaxially parallel offset relationship relative to a main shaft 14 rotatably mounted within the engine block 13. A valve cover 15 overlies the cylinder head 11 to enclose a valve assembly therewithin. The cylinder head 11 includes an intake port 17 and exhaust port 17*a* associated with each piston cylinder 22. A crankcase housing 16 includes an oil drain plug 18 to permit drainage of oil thereform for servicing of the organization. A distributor 19 with an associated distributor drive shaft and gear 19*a* are in operative association with the main shaft 14. A fly wheel 20 is fixedly mounted to the main shaft coaxially aligned therewith and positioned exteriorly of the engine block housing 13 secured to a rear terminal end of the main shaft 14, as illustrated in FIG. 3. Each of the three piston cylinders 22 includes a piston 23 reciprocatably mounted therewithin. A piston connecting rod 21 is secured to each piston 23 coaxially thereof at an upper terminal end of each terminal end of each piston rod, wherein each lower terminal end of each piston connecting rod 21 is mounted to a wobble plate assembly 33. A swivel bearing 32 provides a swivel connection between the lower terminal end of each piston rod 21 and an outer peripheral edge of the wobble plate assembly 33. The wobble plate assembly 33 is defined by an outer wobble plate 33*a* mounted in a fixed relationship rotatably to an inner wobble plate 33*b* rotatably mounted relative to the outer wobble plate 33*a*. A split inner wobble plate bearing 38 and keeper are mounted to associate the inner wobble plate 33*b* with the main shaft 14 and includes a pre-load knot assembly 38*a* (see FIG. 6) to provide desired pre-load to the bearing 38. A wobble plate stabilizer rod 24 is secured to a peripheral end of the outer wobble plate 33*a* at one end and secured to an interior portion of the engine block housing 13 at its other end within the crankcase housing 16 (see FIG. 2) to maintain the outer wobble plate 33*a* in a fixed relationship relative to the engine block housing to maintain alignment of the piston rods 21 and their associated pistons 23 within each respective cylinder 22.

An oil pump pickup 25 directed within the crankcase housing 16 is in operative association with an oil pump 26, including a gear pump with spur gears 25*a* to drive the associated distributor 19. Oil seals 27 are provided in surrounding relationship relative to a rear terminal end of the main shaft 14 to prevent oil leakage from within the engine block housing 13 exteriorly thereof. The main shaft 14 is rotatably mounted within main shaft bearings 31 in coaxial alignment within the engine block housing 13, including a thrust bearing 31*a* to maintain alignment coaxially of the main shaft 14 within the housing 13.

To maintain fixed positioning of the inner wobble plate 33 relative to the main shaft 14, a wobble plate key 34 positively secures in a fixed relationship the inner wobble plate 33 relative to the main shaft 14. It is also understood that angular orientation of the wobble plate assembly 33 to the main shaft 14 determines the stroke length of the engine in reciprocation of the pistons 23 within their respective cylinders 22. Mounted within the cylinder head 11 is a valve associated with each intake port and exhaust port 17 and 17*a* respectively. For purposes of illustration, a single intake valve 37 associated with the exhaust port 17 is illustrated in FIG. 3. The valve assembly includes a conventional valve spring and keeper to maintain the valve spring in operative association with the cylinder head. A rocker arm 36 is pivotally mounted within the cylinder head to provide selective opening and closure of each valve in a conventional manner in a timed relationship relative to a four-cycle engine.

A first cam drive gear 39 (see FIGS. 4 and 7) is mounted on an outer gear drive shaft 48 parallel to a main shaft 14 and positioned adjacent the housing 13. An intermediate gear 40 is mounted upon an intermediate shaft 49 in cooperation with the first drive gear 39 cooperating with a main shaft gear 41 mounted on the main shaft 14. The outer gear shaft 48 mounts a second cam drive gear 42 spaced parallel to the first cam drive gear 39 to effect reverse rotation of the cam plate 29 by engagement of the cam plate gear 43 with the second cam drive gear 42. The cam plate gear 43 is formed in a surrounding coaxially relationship with the cam plate 29. The cam plate 29 includes a cam plate surface 29*a* orthogonally arranged relative to the main shaft axis of the main shaft 14, wherein a plurality of exhaust and intake projections 44 are arranged diametrically opposed to a second pair of exhaust and intake projections 45. The cam plate 29 is arranged to rotate at one-fourth the speed of the main shaft 14, wherein the first and second pair of exhaust and intake projections mounted upon the cam plate surface 29*a* effect timed opening and closure of the intake and exhaust values of the three cylinder engine defined by the instant invention. A cam plate cylindrical sleeve 146 is mounted to the main shaft 14 to secure the cam plate 29 in alignment with the remain shaft, wherein a plurality of spaced cam bearings 28 rotatably mount the cam plate 29 about the cylindrical sleeve 146 in use.

Mounting of the cam plate in alignment with the main shaft 14 to effect actuation of the rocker arms 36 provides a compact longitudinally aligned unit of reduced weight and geometric configuration to provide a compact organization of universal application.

It is noted that a wobble plate intermediate bearing 46 rotatably mounts the inner wobble plate 33*b* to the outer wobble plate 33*a* to permit relative rotation of the inner and outer wobble plates relative to one another.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be restored to, falling within the scope of the invention.

What is claimed as being new and desired to be protected by Letters Patent of the United States is as follows:

1. A wobble plate internal combustion engine including elongate longitudinally aligned engine block housing, the housing including a main shaft rotatably mounted therewithin, the main shaft including a wobble plate assembly obliquely mounted on the main shaft and coupled to the main shaft by a split bearing coaxially fixing the wobble plate assembly relative to the main shaft, and the wobble plate assembly including an outer wobble shaft assembly non-rotatably mounted relative to the engine block housing mounting an inner wobble plate interiorly thereof, wherein the inner wobble plate is mounted to the main shaft, and a bearing assembly rotatably mounting the inner wobble plate to the outer wobble plate, and the engine block housing including a plurality of piston cylinders fixedly mounted equally spaced relative to one another within the engine block housing, each piston cylinder arranged parallel to the main shaft, and each piston cylinder including a piston reciprocally mounted therewith, and each piston including a piston rod mounting each piston to the outer wobble plate, and the engine block housing including a cylinder head, wherein the cylinder head is fixedly mounted to a forward terminal end of the engine block housing overlying each piston cylinder, and each piston cylinder including an intake valve and an exhaust valve mounted overlying each piston, and a cam plate rotatably and coaxially fixedly mounted to a forward terminal end of the engine block housing, and a rocker arm overlying each valve and positioned between the valve and the cam plate, wherein the cam plate selectively actuates each valve, and wherein the main shaft includes a main shaft gear mounted fixedly thereon, the main shaft gear in cooperative relationship with an intermediate gear, the intermediate gear in cooperative rotative association with a first drive gear, the first drive gear mounted coaxially and fixedly to an outer gear drive shaft, the outer gear drive shaft positioned adjacent an interior surface of the engine block housing, and the outer gear drive shaft including a second cam drive gear, the second cam drive gear in rotative relationship with a cam plate gear, the cam plate gear in surrounding relationship relative to the cam plate to effect reverse rotation of the cam plate relative to the main shaft, and wherein the cam plate includes a cam plate surface orthogonally arranged relative to an axis defined by the main shaft, the cam plate surface including a first projections, and a second pair of projections, the first pair of projections and the second pair of projections diametrically arranged relative to one another upon the cam plate surface, and the first and second pair of projections arranged to effect actuation of each rocker arm mounted to the cylinder head, and wherein each piston rod is mounted to the outer wobble plate, including a swivel bearing to permit swivelling of each piston rod relative to the wobble plate assembly, and including a wobble plate stabilizer rod, the wobble plate stabilizer rod fixedly mounted to the outer wobble plate at a peripheral portion of the outer wobble plate, to a forward end of the wobble plate stabilizer rod, and the wobble plate stabilizer rod fixedly mounted to an interior surface of the engine block housing at a rear terminal end of the wobble plate stabilizer rod to non-rotatably orient the outer wobble plate relative to the engine block housing.

* * * * *